US010431039B2

(12) United States Patent
Shiraishi

(10) Patent No.: US 10,431,039 B2
(45) Date of Patent: Oct. 1, 2019

(54) GAMING MACHINE, GAMING METHOD, AND COMPUTER-READABLE RECORDING MEDIUM

(71) Applicant: KONAMI GAMING, INC., Las Vegas, NV (US)

(72) Inventor: Kazutaka Shiraishi, Zama (JP)

(73) Assignee: KONAMI GAMING, INC., Las Vegas, NV (US)

( * ) Notice: Subject to any disclaimer, the term of this patent is extended or adjusted under 35 U.S.C. 154(b) by 0 days.

(21) Appl. No.: 15/123,230

(22) PCT Filed: Mar. 4, 2015

(86) PCT No.: PCT/JP2015/056395
§ 371 (c)(1),
(2) Date: Sep. 1, 2016

(87) PCT Pub. No.: WO2015/133534
PCT Pub. Date: Sep. 11, 2015

(65) Prior Publication Data

US 2017/0076536 A1 Mar. 16, 2017

(30) Foreign Application Priority Data

Mar. 4, 2014 (JP) ..... 2014-041596

(51) Int. Cl.
*G07F 17/32* (2006.01)
*G07F 17/34* (2006.01)

(52) U.S. Cl.
CPC ..... *G07F 17/3213* (2013.01); *G07F 17/3244* (2013.01); *G07F 17/34* (2013.01)

(58) Field of Classification Search
CPC ... G07F 17/3213; G07F 17/34; G07F 17/3244
See application file for complete search history.

(56) References Cited

U.S. PATENT DOCUMENTS 4,711,451 A * 12/1987 Pajak ..... G07F 17/3244 273/143 R
5,209,479 A * 5/1993 Nagao ..... G07F 17/3244 273/143 R (Continued)

FOREIGN PATENT DOCUMENTS

JP 2004321389 A 11/2004
JP 2005118202 A 5/2005

(Continued)

OTHER PUBLICATIONS

International Search Report and Written Opinion (PCT/JP2015/056395); dated May 12, 2015.

*Primary Examiner* — Tramer Y Harper
(74) *Attorney, Agent, or Firm* — Howard & Howard Attorneys PLLC

(57) ABSTRACT

A gaming machine according to an aspect of the present invention includes a display device displaying a plurality of reels, each reel having a plurality of symbol regions populated with symbols, at least one of the plurality of reels having a symbol region group including the symbol regions in a row, and a controller connected to the display device to control display of the display device. The controller determines a stop position by one unit stop position for the symbol region group in at least one reel, when spinning and stopping each of the plurality of reels displayed on the display device.

15 Claims, 15 Drawing Sheets

(56) References Cited

U.S. PATENT DOCUMENTS

| | | | | |
|---|---|---|---|---|
| 5,863,249 | A * | 1/1999 | Inoue | G07F 17/3244 273/143 R |
| 6,251,013 | B1 * | 6/2001 | Bennett | G07F 17/3211 273/143 R |
| 6,443,837 | B1 * | 9/2002 | Jaffe | G07F 17/32 463/16 |
| 8,267,770 | B2 | 9/2012 | Mizue | |
| 9,361,763 | B1 * | 6/2016 | Aoki | G07F 17/326 |
| 2003/0013511 | A1 * | 1/2003 | Suzuki | G07F 17/32 463/16 |
| 2007/0082727 | A1 * | 4/2007 | Ebisawa | G07F 17/32 463/20 |
| 2008/0070672 | A1 * | 3/2008 | Inamura | G07F 17/34 463/20 |
| 2009/0280887 | A1 * | 11/2009 | Yoshizawa | G07F 17/34 463/20 |
| 2010/0285861 | A1 * | 11/2010 | Gowin | G07F 17/3202 463/20 |
| 2011/0059787 | A1 * | 3/2011 | Crossman | G07F 17/3202 463/20 |
| 2011/0059790 | A1 * | 3/2011 | Slomiany | G07F 17/3244 463/22 |
| 2011/0201406 | A1 * | 8/2011 | Jaffe | G07F 17/32 463/21 |
| 2015/0080091 | A1 * | 3/2015 | Saunders | G07F 17/326 463/20 |

FOREIGN PATENT DOCUMENTS

| | | | |
|---|---|---|---|
| JP | 2007259997 | A | 10/2007 |
| JP | 2007275123 | A | 10/2007 |

* cited by examiner (a)

(b)

(a)

(b)

SYMBOL LOT TABLE

| | WEIGHT |
|---|---|
| Wild | 10% |
| PicA | 8% |
| PicB | 8% |
| PicC | 8% |
| PicD | 8% |
| A | 8% |
| K | 8% |
| Q | 8% |
| J | 8% |
| 10 | 8% |
| 9 | 8% |
| Sc | 10% |

100%

GAMING MACHINE, GAMING METHOD, AND COMPUTER-READABLE RECORDING MEDIUM

CROSS-REFERENCE TO RELATED APPLICATIONS

This application is a continuation of International Application No. PCT/JP2015/056395, filed on Mar. 4, 2015. Note that this application claims the benefit of priority from Japanese Patent Application No. 2014-041596, and the entire content of the basic application is incorporated herein.

TECHNICAL FIELD

The present invention relates to a gaming machine, a gaming method, and a computer-readable recording medium.

BACKGROUND ART

Some of slot machines as a kind of gaming machines have been known to stop-display a consecutive symbol group (hereinafter also referred to as stack symbol) having plurality of identical or correlated symbols in a row on a symbol display screen for displaying symbols. Stack symbols include those formed of a plurality of symbols in a row and those formed of a large symbol having a size of a plurality of symbols. In the latter case, specifically, symbols displayed at a time on the symbol display screen often constitute a single large symbol.

Players play a game expecting appearance of a stack symbol, because when such a stack symbol is stop-displayed on the symbol display screen, the possibility of winning of a big prize is high. In particular, when the stack symbol is formed as a large symbol, a large symbol displayed in the symbol display region is also visually effective to further increase the degree of expectations of players for occurrence of a stack symbol.

CITATION LIST

Patent Literature

Patent Literature 1: U.S. Pat. No. 8,267,770

SUMMARY OF INVENTION

Technical Problem

However, in conventional gaming machines, since the stop positions of symbols are controlled with the spacing width (pitch) of one symbol, only a part of a stack symbol may be stop-displayed on the symbol display screen. In this case, the probability of a win is lower than when the entire stack symbol is stop-displayed. Even if a win is achieved, the payment may be low. When the stack symbol is formed of a large symbol, a large symbol depicting a single picture pattern is partially displayed, which may make visual effects worse. When a stack symbol is partially stop-displayed on the symbol display screen in this manner, the player's expectations for a stack symbol decreases, and thus the satisfaction given by the game to the player is reduced.

In this technical field, there is a demand for a gaming machine, a gaming method, or a computer-readable recording medium that can appeal to the player's interest to increase the excitation and give great satisfaction.

Solution to Problem

A gaming machine according to an aspect of the present invention includes a display device displaying a plurality of reels, each reel having a plurality of symbol regions populated with symbols, at least one of the plurality of reels having a symbol region group including the symbol regions in a row, and a controller connected to the display device to control display of the display device. The controller determines a stop position by one unit stop position for the symbol region group in at least one reel, when spinning and stopping each of the plurality of reels displayed on the display device.

In such a gaming machine, the controller determines a stop position by one unit stop position for the symbol region group. This configuration avoids a situation in which the stack symbol is partially displayed when the stack symbol is arranged in the symbol region group. In other words, this configuration enables the entire stack symbol to be always displayed when the stack symbol appears. The gaming machine described above thus can increase the player's expectations for a stack symbol and can appeal to the player's interest to increase the excitement and give great satisfaction.

A gaming machine according to an aspect of the present invention includes a display device displaying a plurality of reels, each reel having a plurality of symbol regions populated with symbols, at least one of the plurality of reels having a symbol region group including the symbol regions in a row. The controller provides a first game and a second game. When spinning and stopping each of the plurality of reels displayed on the display device, the controller determines a stop position of the reel in units of the symbol regions in the first game and a stop position by one unit stop position for the symbol region group in the second game.

In such a gaming machine, the controller provides a first game that determines a position to stop the reel in units of symbol regions and a second game that determines a stop position by one unit stop position for the symbol region group. Thus, the first game in which the entire stack symbol is not always displayed and the second game in which the entire stack symbol is always displayed can be used in combination. In the second game in which the entire stack symbol is always displayed, the win rate, the payout rate and/or the degree of variations (volatility) of payment is higher than that in the first game. This enables provision of games of different natures using the plurality of reels having the same layout. This configuration appeals to the player's interest to increase the excitement and give great satisfaction.

In an embodiment, the second game is provided when a predetermined condition is satisfied in the first game.

In an embodiment, the symbol region group is populated with identical or correlated symbols in the symbol regions that form the symbol region group. The entire stack symbol is displayed when the controller determines the symbol region group that includes symbol regions populated with identical or correlated symbols (individual symbols of a stack symbol), as the stop position.

In an embodiment, the identical symbols are determined by a drawing of lots by the controller. In this case, the reel stop position and the kind of identical symbols are separately determined by the controller.

In an embodiment, the correlated symbols constitute a single picture pattern as a whole. In this case, a picture pattern larger than the symbol region can be displayed.

In an embodiment, when the symbol region group determined to be displayed on the display device is neither populated with the identical nor correlated symbols, the controller determines symbols to be displayed in the symbol regions of the symbol region group by an individual drawing of lots. In this case, a combination of symbols displayed in the symbol regions can be changed with games.

In an embodiment, the controller performs a winning determination by a combination of symbols displayed on the display device. That is, the controller determines the presence/absence of a win, the payment, and the like by a winning determination (line determination) with a combination of symbols.

In an embodiment, the number of symbol regions that form the symbol region group is equal to the number of symbol regions displayed by the display device for each reel that includes the symbol region group. When the symbol region group stops in a certain reel, the reel is occupied by the symbol region group.

A gaming method according to an aspect of the present invention provides a game using a display device and a controller. The display device displays a plurality of reels, each reel having a plurality of symbol regions populated with symbols, at least one of the plurality of reels having a symbol region group including the symbol regions in a row. The controller is connected to the display device to control display of the display device. The method includes a step of determining, by the controller, a stop position by one unit stop position for the symbol region group in at least one reel, when spinning and stopping each of the plurality of reels displayed on the display device.

In such a gaming method, the controller determines a stop position by one unit stop position for the symbol region group. This configuration avoids a situation in which the stack symbol is partially displayed when the stack symbol is arranged in the symbol region group stopped in the symbol region. In other words, this configuration enables the entire stack symbol to be always displayed when the stack symbol appears. The gaming method described above thus can increase the player's expectations for a stack symbol and can appeal to the player's interest to increase excitement and give great satisfaction.

A computer-readable recording medium according to an aspect of the present invention stores a program for causing one or more computers to implement a function of providing a game using a display device and a controller. The display device displays a plurality of reels, each reel having a plurality of symbol regions populated with symbols, at least one of the plurality of reels having a symbol region group including the symbol regions in a row. The controller is connected to the display device to control display of the display device. The program causes the one or more computers to function as a controller that determines a stop position by one unit stop position for the symbol region group in at least one reel, when spinning and stopping each of the plurality of reels displayed on the display device.

In such a computer-readable recording medium, the stored program causes one or more computers to function as a controller that determines a stop position by one unit stop position for the symbol region group. This configuration avoids a situation in which the stack symbol is partially displayed when the stack symbol is arranged in the symbol region group. In other words, this configuration enables the entire stack symbol to be always displayed when the stack symbol appears. The computer-readable recording medium described above thus can increase the player's expectations for a stack symbol and can appeal to the player's interest to increase the excitement and give great satisfaction.

Advantageous Effects of Invention

An aspect of the present invention and various modifications provide a gaming machine, a gaming method, and a computer-readable recording medium that can appeal to the player's interest to increase the excitement and give great satisfaction.

DESCRIPTION OF EMBODIMENTS

Embodiments of the present invention will be described below with reference to the accompanying drawings. In the figures, the same or corresponding parts are denoted with the same reference signs, and an overlapping description will be omitted.

First Embodiment

A gaming machine 1 according to a first embodiment may be employed as a machine providing games to players in casinos, such as a slot machine, a poker machine, a keno machine, a bingo machine, a pachinko machine, and a pachislot machine, that provides a game in exchange for a wager and grants awards such as payments in accordance with the result of the game. The wager is a concept including tangibles such as hard currency, paper currency, coins, medals, and tickets, or electronic data having values equivalent to these tangibles. Placed in the gaming machine 1, such a wager is converted into the number of credits, which are units of consumption, and accumulated to be used in such manner that the accumulated credits are consumed to provide the player with a game.

In the example described below, the gaming machine 1 is a slot machine that includes reels having a plurality of symbols, spins the reels and thereafter stops the reels, and determines the presence/absence of a win according to a plurality of symbols displayed when the reels stop.

Figure 1:
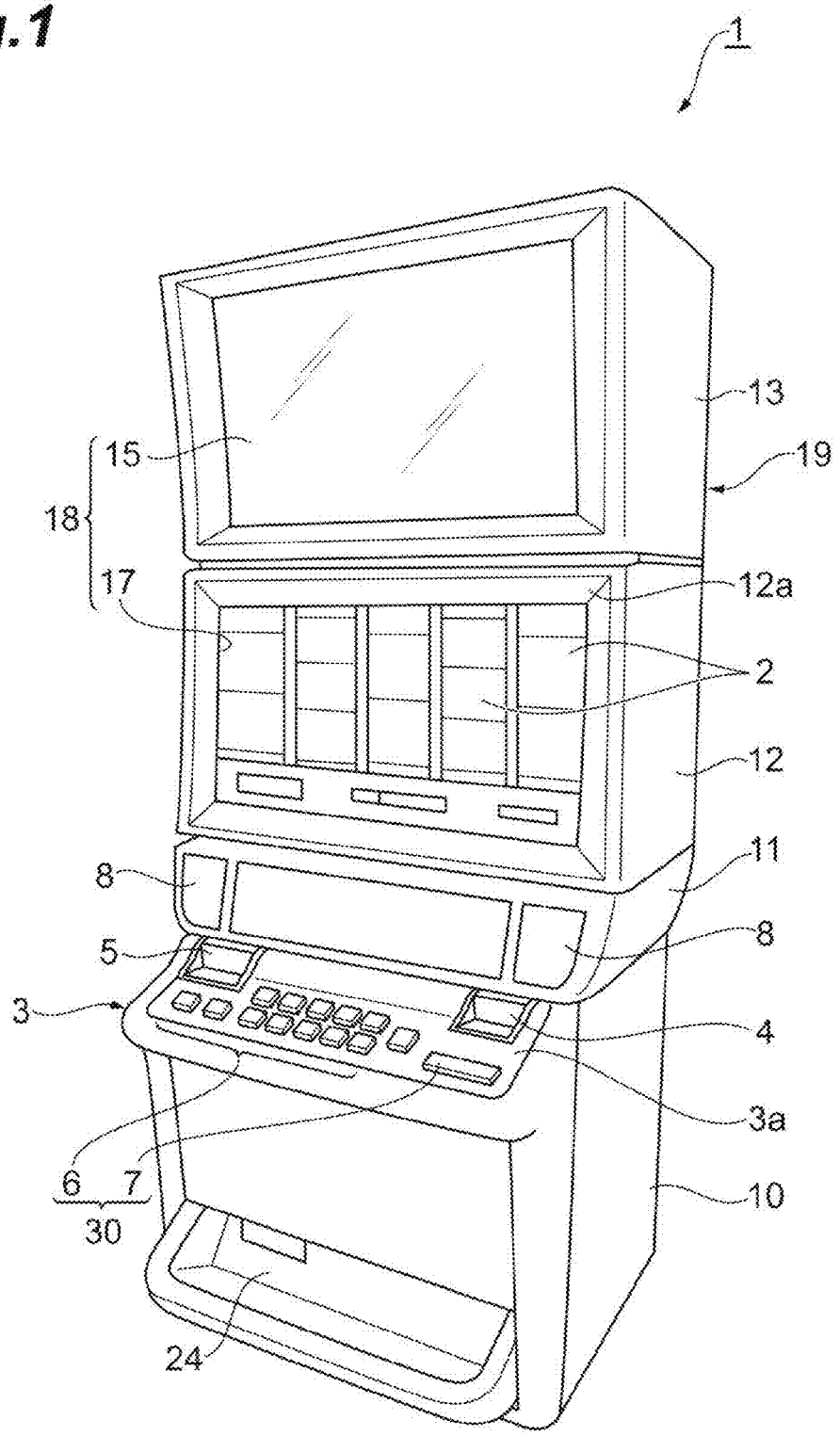
FIG. 1 is a perspective view of a gaming machine according to a first embodiment.

FIG. 1 is a perspective view of the gaming machine 1 according to the embodiment. As illustrated in FIG. 1, the gaming machine 1 includes a vertical housing 19 extending in the vertical direction.

The housing 19 includes a lower-side display box 12, an upper-side display box 13 provided on the upper side of the lower-side display box 12, and a bottom cabinet 10 provided on the lower side of the lower-side display box 12.

The upper-side display box 13 includes an upper display device 15 that may display images or videos related to the contents of a game. The lower-side display box 12 includes a lower display device 17 that may display a plurality of reels on the front 12*a*. Such display devices 15 and 17 function as a display unit 18 that displays the contents of a game.

Below the display unit 18, a control panel 3 is provided. More specifically, the control panel 3 is provided on the bottom cabinet 10. The control panel 3 has a front surface 3*a* having an insertion port 4, an output port 5, and an operating unit 30. The player places a wager into the insertion port 4 in exchange for playing a game. Here as an example, coins or bills are used as a wager. A voucher ticket, which is a medium with printed information of the credit accumulated in the gaming machine 1, is outputted from the output port 5, for example, in response to a payout button described later being operated. The insertion port 4 or the output port 5 may be further configured to read credit information printed on a ticket and accumulate the read credit information in the gaming machine 1. In this case, the credits can be accumulated in the gaming machine 1, based on the read credit information.

The operating unit 30 accepts player's various instructions to the gaming machine 1. The operating unit 30 has, for example, a SPIN button 7 and a plurality of buttons 6. The SPIN button 7 accepts an instruction to start a game (start spinning of the reels). Examples of the buttons 6 include bet buttons, line designating buttons, a max bet button, and a payout button. The bet buttons accept the operation of designating the credit that is bet by the player in a predetermined unit amount. The line designating buttons accept the operation of designating the line along which a win determination is to be made (hereinafter called effective line). The max bet button accepts the operation of giving an instruction to bet the maximum play value that can be bet at a time. The payout button accepts the operation of giving an instruction to pay out.

A payout tray 24 for paying out the play value is provided below the control panel 3. The payout tray 24 is provided in the bottom cabinet 10. When the payout button is operated, the gaming machine 1 may output the information of accumulated credits to the output port 5 or may pay out the wager to the payout tray 24, either of which is selected according to the setting of the gaming machine 1. Either may be selected in accordance with player's designation.

A speaker box 11 is disposed between the lower-side display box 12 and the bottom cabinet 10. A plurality of speakers 8 are provided on the front surface of the speaker box 11. The speakers 8 may output sound, for example, with progress of the game. The speakers 8 may output sound even when the gaming machine 1 is providing no game.

Figure 2:
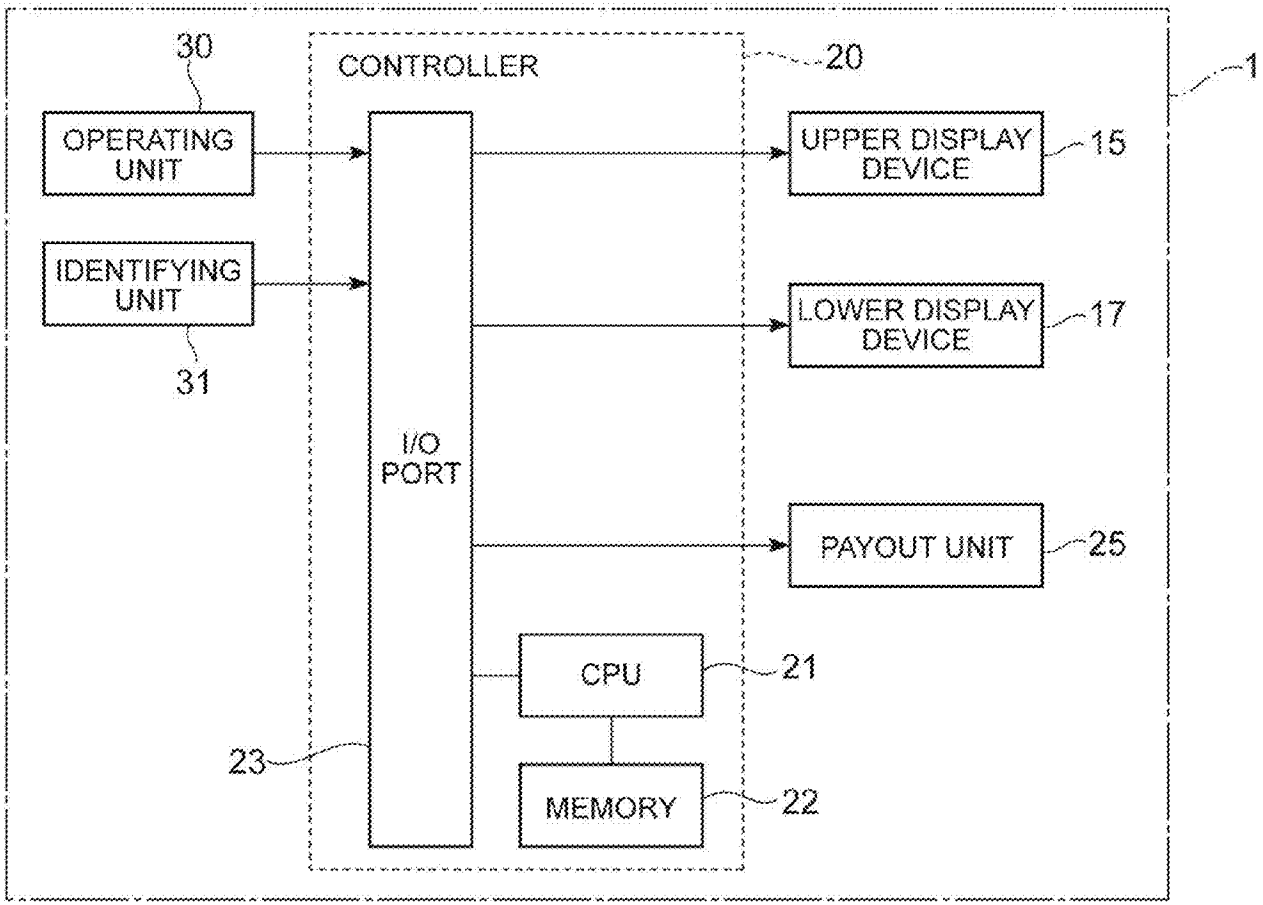
FIG. 2 is a block diagram of a control system in the gaming machine in FIG. 1.

FIG. 2 schematically shows an overview of a control system in the gaming machine 1 described above. The gaming machine 1 includes a controller 20. The controller 20 is configured as a computer unit including a central processing unit (hereinafter abbreviated as CPU) 21 and a memory 22 that the CPU 21 can refer to. The memory 22 may include a magnetic or optical recording medium or a nonvolatile storage medium such as EEPROM. The memory 22 stores a game program necessary for execution of a game and game data to be referred to in the game program. The memory 22 stores data related to reels 2 described later, as the game data to be referred to in the game program. The CPU 21 reads and executes the game program to determine the contents of a game and allows a slot game to proceed under a predetermined procedure. The controller 20 can be stored, for example, in the bottom cabinet 10 of the housing 19. The controller may be separate from the housing 19 and provided on a network such as a local area network (LAN) or a wide area network (WAN). In the following, the operation of the controller 20 is explained as the operation of the CPU 21.

The CPU 21 is connected with the operating unit 30 and an identifying unit 31 via an input/output (I/O) port 23. The operating unit 30 receives a player's instruction and outputs a signal corresponding to the player's instruction to the CPU 21. The identifying unit 31 identifies the wager (such as coins, bills, or tickets, and the like.) inserted from the inserting port 4 and outputs a signal corresponding to the identified amount to the CPU 21.

The CPU 21 determines the contents of a game based on the player's instruction, the bet credit, and the like. The CPU 21 is further connected with the upper display device 15, the lower display device 17, and a payout unit 25 through an I/O port 23. The CPU 21 activates at least one of the upper display device 15 and the lower display device 17 according to the determined contents of the game and displays the contents of the game in a display region. Here, the display region is the display panel of a display device when the display unit 18 is a display device.

The CPU 21 controls spinning of the reels 2 displayed on the lower display device 17 in accordance with the determined contents of the game. The CPU 21 allows the payout unit 25 to manage payout of the wager to the payout tray 24 and allows the output port 5 to print information of the number of accumulated credits on a medium and output the printed information. Besides, necessary devices for executing slot games are connected to the controller 20 as appropriate, even though not shown in the figures.

Figure 3:
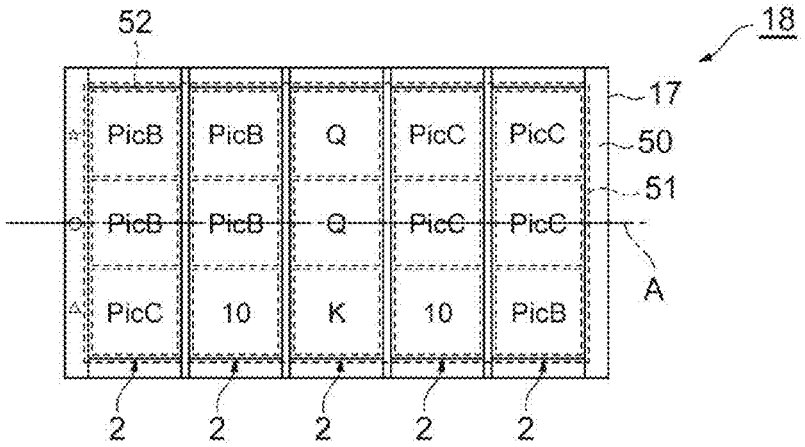
FIG. 3 is a diagram showing symbols displayed on a game screen, in which (a) is a diagram showing an example of the game screen and (b) is a diagram showing an example of reels.
Figure 3:
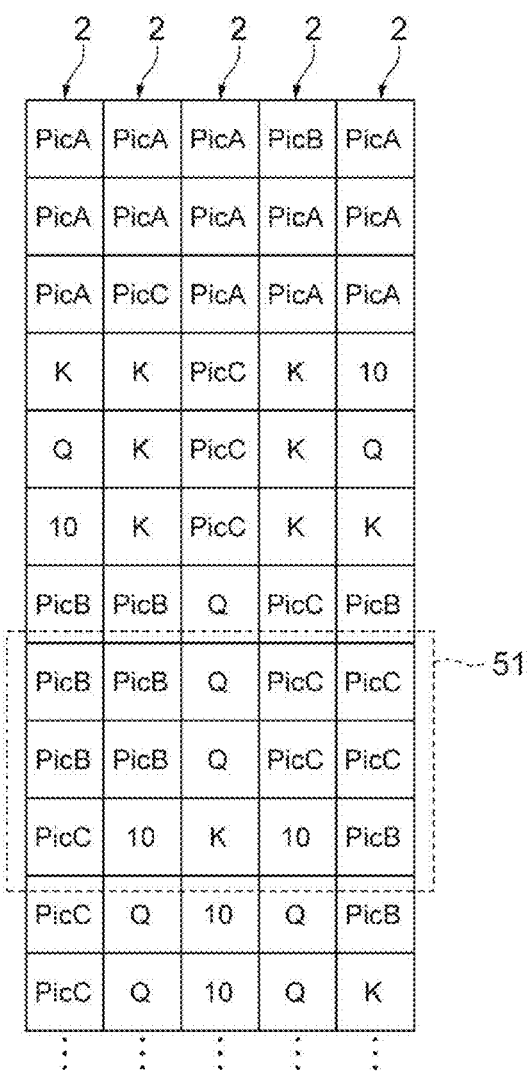

(a) of FIG. 3 shows an example of a screen of a slot game appearing on the display unit 18 under the control of the CPU 21. As shown in FIG. 3, a game screen 50 appears on the lower display device 17 of the display unit 18. A plurality of reels 2 are displayed on the game screen 50. The reels 2 are virtually configured video reels on which, for example, a plurality of symbols selected from "9", "10", "J", "Q", "K", "A", "PicA", "PicB", "PicC", and "PicD" are arranged. The game screen 50 includes a symbol display region 51 for displaying symbols on the reels 2. Here, in the symbol display region 51, a plurality of cells 52 serving as symbol stop positions are defined to form a matrix of three rows in the vertical direction and five columns in the horizontal direction. The horizontal direction in the game screen 50 may hereinafter be referred to as row direction and the vertical direction may be referred to as column direction. As shown in (b) of FIG. 3, the cells 52 for each column in the symbol display region 51 are associated with a reel 2. In a predetermined spin period, the symbols on the reels 2 are displayed to be moving (scrolling) in the column direction in the symbol display region 51. In a predetermined stop period, the symbols on the reels 2 are displayed to stop scrolling in the symbol display region 51. The boundary between cells 52 may be displayed so as to be visually grasped by the player or may not be displayed. That is, it is only necessary to logically or conceptually define the cells 52 as the symbol stop positions in the inside of the gaming machine 1, and visual recognition of the boundary between the cells is not necessarily required.

The effective line is a line that designates a plurality of cells 52 to be served as targets of a win determination in the slot game and is set to extend over the reels 2. The effective line may be properly set by the player operating the line designating button group of the operating unit 30, or the effective line may be properly set by operating the bet button. An example of the effective line that can be set is a horizontal line A that connects all the cells 52 located in the vertical center of the symbol region 51. Some other examples are the effective line being set to a line extending in a diagonal direction of the symbol region 51, or a line having a V shape or an inverted V shape in the symbol region 51. When the player operates the bet button group to designate the number of units to be bet in a slot game and selects the effective line with the line designating button group, the CPU 21 recognizes those selection contents. Thereafter, when the player operates the spin button 7, the CPU 21 moves (scrolls) each of the symbols to the column direction in the symbol region 51 to stop the scroll of the symbols in a predetermined stop period such that one symbol appears in one cell 52. When the symbols are stopped, a winning pattern is formed when the designs of the symbols displayed in the cells 52 on the effective line match or forming a predetermined relation. In the following explanation, a win determination using the effective line is referred to as line determination.

Further, a determination method other than the line determination described above may be employed. For example, some or all of the symbol regions 40*a* may be specified as a determination region, and if a predetermined number of specific symbols are present in the determination region, it may be determined that a win is achieved. Alternatively, if specific symbols successively appear on a predetermined number of reels continuous from the reel on the right end or the left end of the symbol display region 51, it may be determined that a win is achieved. Such a win determination is hereinafter referred to as scatter determination.

The symbols are predetermined as virtual reel strips serving as symbol arrangements that are virtually configured to correspond to the respective reels 2, and recorded in the memory 22 as a part of the game data. The CPU 21 refers to the data recorded in the memory 22 to control display of the reels 2 in the game display 50.

Figure 4:
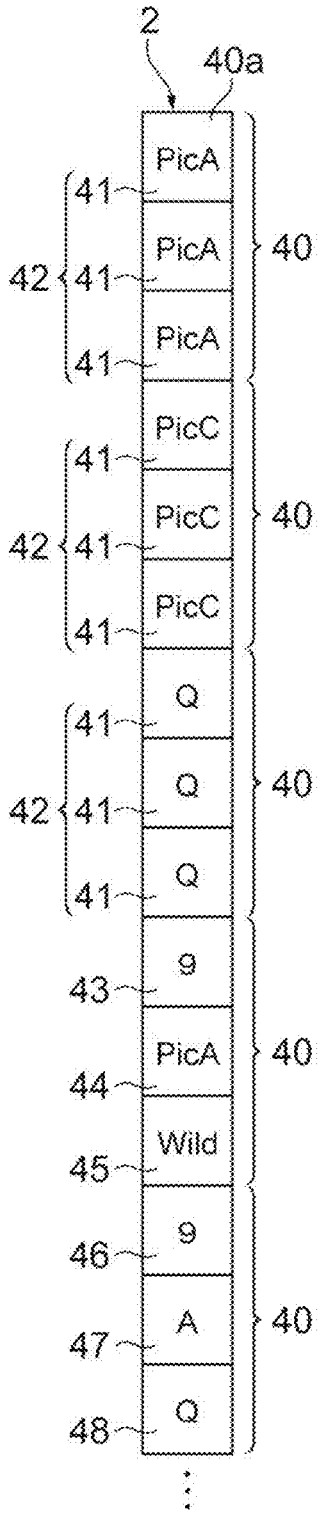
FIG. 4 is a diagram showing an example of a reel according to the first embodiment.

FIG. 4 is a diagram showing an example of symbol arrangement on the reel 2 that is defined as a virtual reel strip. The reel 2 includes a plurality of symbol regions 40*a*, each populated with a symbol, and is divided by symbol region groups 40, each including three symbol regions 40*a* in a row. The number of the symbol regions 40*a* is designed to be a multiple of three, and each symbol region 40*a* on the reel 2 is included in any one of the symbol region groups 40.

In some symbol region groups 40 of a plurality of symbol region groups 40 included in the reel 2, three symbol regions 40*a* that form a symbol region group 40 are populated with identical symbols 41 (for example, symbols "PicA", "PicC", "Q" shown in FIG. 4). These identical symbols 41 constitute a stack symbol 42. In the example in FIG. 4, three symbol region groups 40 are populated with stack symbols 42.

In the other symbol region groups 40 of a plurality of symbol region groups 40 included in the reel 2, non-stack symbols are displayed. Three symbol regions 40*a* that form a symbol region group 40 are populated with three symbols 43 to 45, 46 to 48 different from each other.

Figure 5:
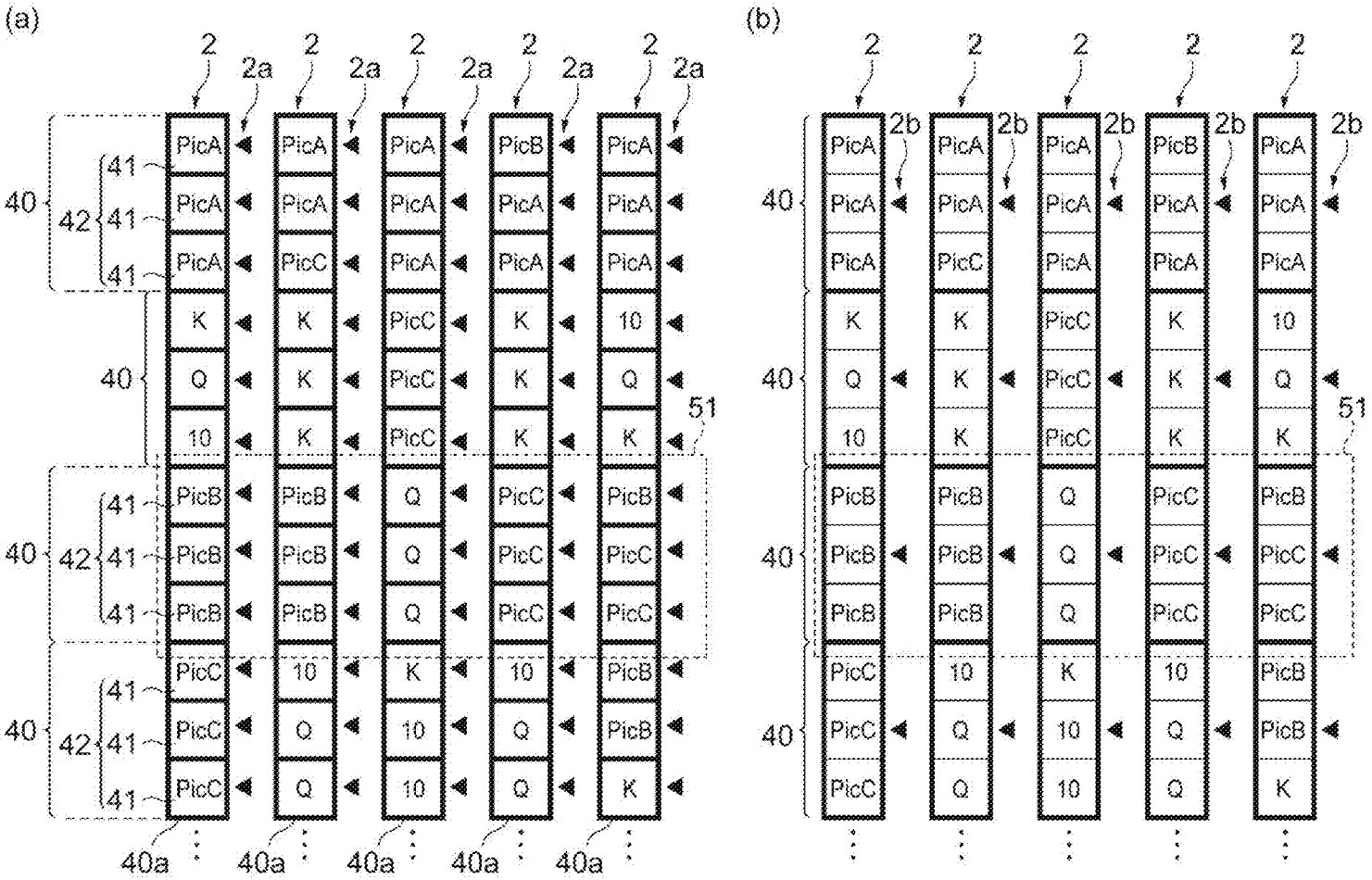
FIG. 5 is a diagram showing virtual reel strips of the reels with (a) symbol region-unit stop positions and (b) symbol region group-unit stop positions.

(a) and (b) of FIG. 5 are diagrams showing virtual reel strips that are symbol arrangements for all the reels 2 displayed on the game screen 50, with their stop positions, namely, symbol region-unit stop positions 2*a* and symbol region group-unit stop positions 2*b*. (a) of FIG. 5 shows the symbol region-unit stop positions 2*a* of the reels 2. The symbol region-unit stop position 2*a* denoted by ▲ is set in each of the symbol regions 40*a* included in the reels 2. With this configuration, when the reels 2 are stopped by the symbol region-unit stop positions 2*a*, the stop positions are determined in units of symbol regions 40*a*, regardless of the symbol region groups 40. For example, even when the symbol region group 40 is populated with the stack symbol 42 of identical symbols 41, the stop position is determined on any one of the identical symbols 41 that forms the stack symbol 42. Thus, the manner in which the stack symbol 42 stops in the symbol display region 51 is indefinite. In this configuration, the stack symbol 42 may be displayed partially or may be displayed entirely.

By contrast, (b) of FIG. 5 shows the symbol region group-unit stop positions 2*b* on the reels 2. The symbol region group-unit stop position 2*b* denoted by ▲ is set in each of the symbol region groups 40 included in the reels 2. In this manner, when the reels 2 are stopped by the symbol region group-unit stop positions 2*b*, the stop positions are determined in units of symbol region groups 40. The manner in which the stack symbol 42 stops in the symbol display region 51 is definite. When the stack symbol 42 stops, the entire stack symbol 42 including three symbols is always displayed, and the stack symbol 42 occupies one column (reel) in the symbol display region 51.

The CPU 21 determines stop positions of the reels 2 using either of the symbol region-unit stop positions 2*a* and the symbol region group-unit stop positions 2*b* and determines game contents based on this. When the symbol region group-unit stop position 2*b* is used, wins by the stack symbol 42 increase, compared with when the symbol region-unit stop position 2*a* is used on the same reel 2, and therefore, the win rate, the payout rate and/or the degree of variation (volatility) of payment is higher. When the symbol region-unit stop position 2*a* is used, the entire stack symbol 42 does not always stop in the symbol display region 51, whereas when the symbol region group-unit stop position 2*b* is used, the entire stack symbol 42 always stops in the symbol display region 51. This appeals to the player's interest to increase the excitement and gives the player great satisfaction.

The control for stopping the reels 2 as described above can be implemented, for example, by using a table that defines stop positions of the reels 2 in accordance with the values of random numbers, and referring to the table by the random numbers acquired by the CPU 21. When the reels 2 are stopped using only the symbol region group-unit stop positions 2*b*, the table may be the one related only to the symbol region group-unit stop positions 2*b*. When both of the symbol region-unit stop positions 2*a* and the symbol region group-unit stop positions 2*b* are used, a table related to both is used. Such a table may be included in the program or may be implemented as a data structure different from the program.

Figure 6:
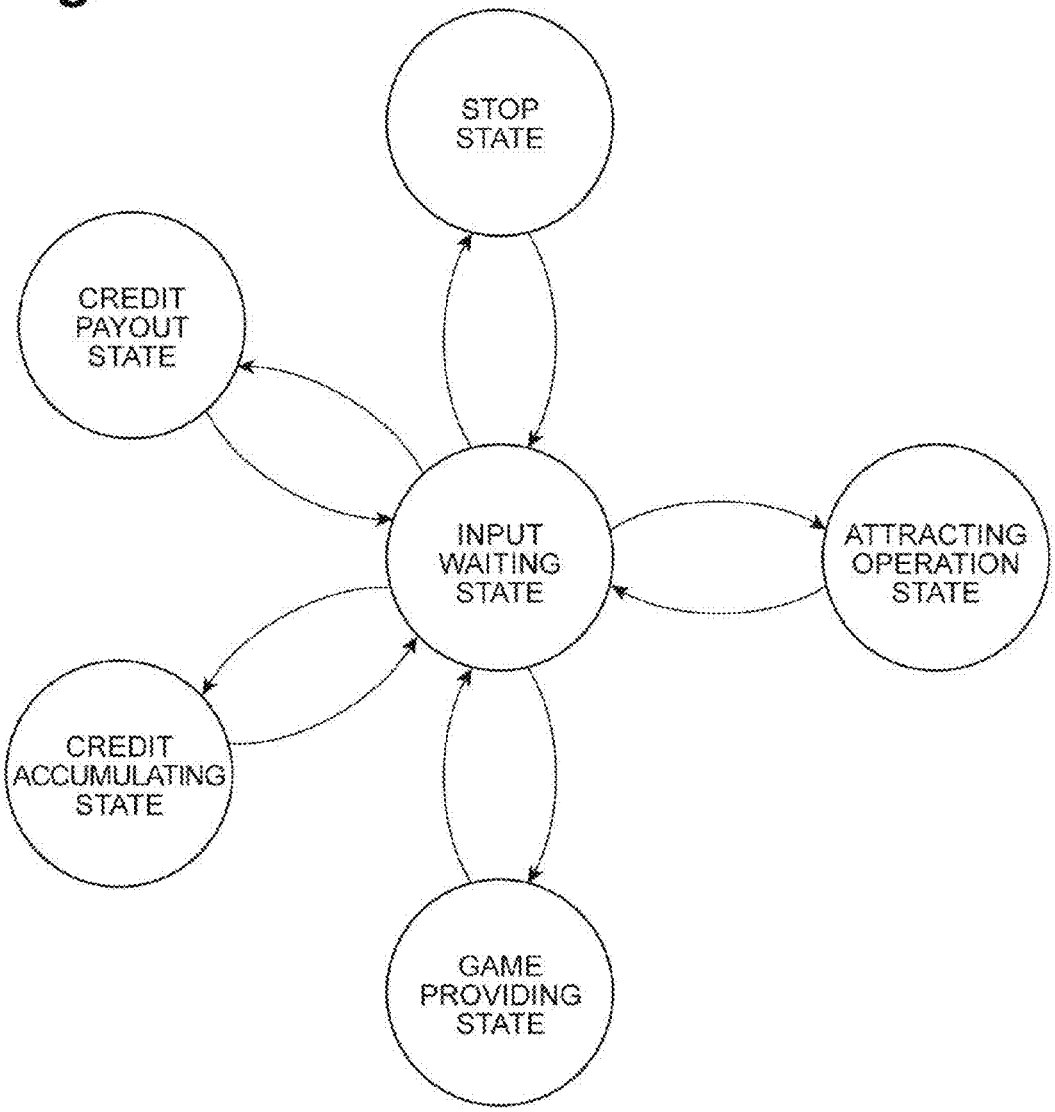
FIG. 6 is a state transition diagram of the gaming machine according to the first embodiment.

The following is an explanation of operations of the gaming machine 1 according to the present embodiment, with reference to FIG. 6. FIG. 6 is a state transition diagram of the gaming machine 1 configured as described above according to the present embodiment. As illustrated in FIG. 6, the gaming machine 1 changes to the states including a stop state, an input waiting state, a credit payout state, a credit accumulating state, an attracting operation state, and a game providing state. The following is an explanation of these states.

The stop state indicates that the gaming machine 1 is not being activated. The gaming machine 1 in the stop state is activated and initialized when a certain activating operation is received, a predetermined program is executed by the controller 20 and a game display is displayed on the display unit 18, and then the gaming machine 1 changes its state to the input waiting state.

As for the gaming machine 1 in the input waiting state, when a bill/ticket identifying unit 55 identifies a bill or a ticket, the gaming machine 1 changes to the credit accumulating state to accumulate corresponding credit information in the gaming machine 1, and returns to the input waiting state when accumulation of the credit ends. When the gaming machine 1 in the input waiting state receives an operation of the payout button in a state where credit information is accumulated, the gaming machine 1 changes its state to the credit payout state to perform a payout process of the accumulated credit and output a ticket including printed information corresponding to the credit payout processing from a printer unit 56, and reset the credit accumulated in the gaming machine 1 to zero. The gaming machine 1 that has finished the processing returns to the input waiting state.

When the gaming machine 1 in the input waiting state is not operated for a predetermined time, the state changes to the attracting operation state to display an attraction display on the display unit 18. When the gaming machine 1 in the attracting operation state receives some operation, it returns to the input waiting state. The attraction display is a display to appeal to customers in the casino for the existence of the gaming machine 1, and consist of predetermined images and/or animations.

The gaming machine 1 in the input waiting state sets the number of lines and the number of bets of the game by receiving an operation of the line selection button, the bet number selection button, or the max bet button in a state where the credit is accumulated inside, and receives an operation of the start button to reduce the credit amount by the amount obtained by multiplying the set number of lines and the credit amount and change to the game providing state. In the game providing state, the gaming machine 1 provides a game in accordance with the flowcharts illustrated in FIG. 7 and FIG. 8. The gaming machine 1 may also change to the game providing state in response to an operation of the bet number selection button or the max bet button.

Figure 7:
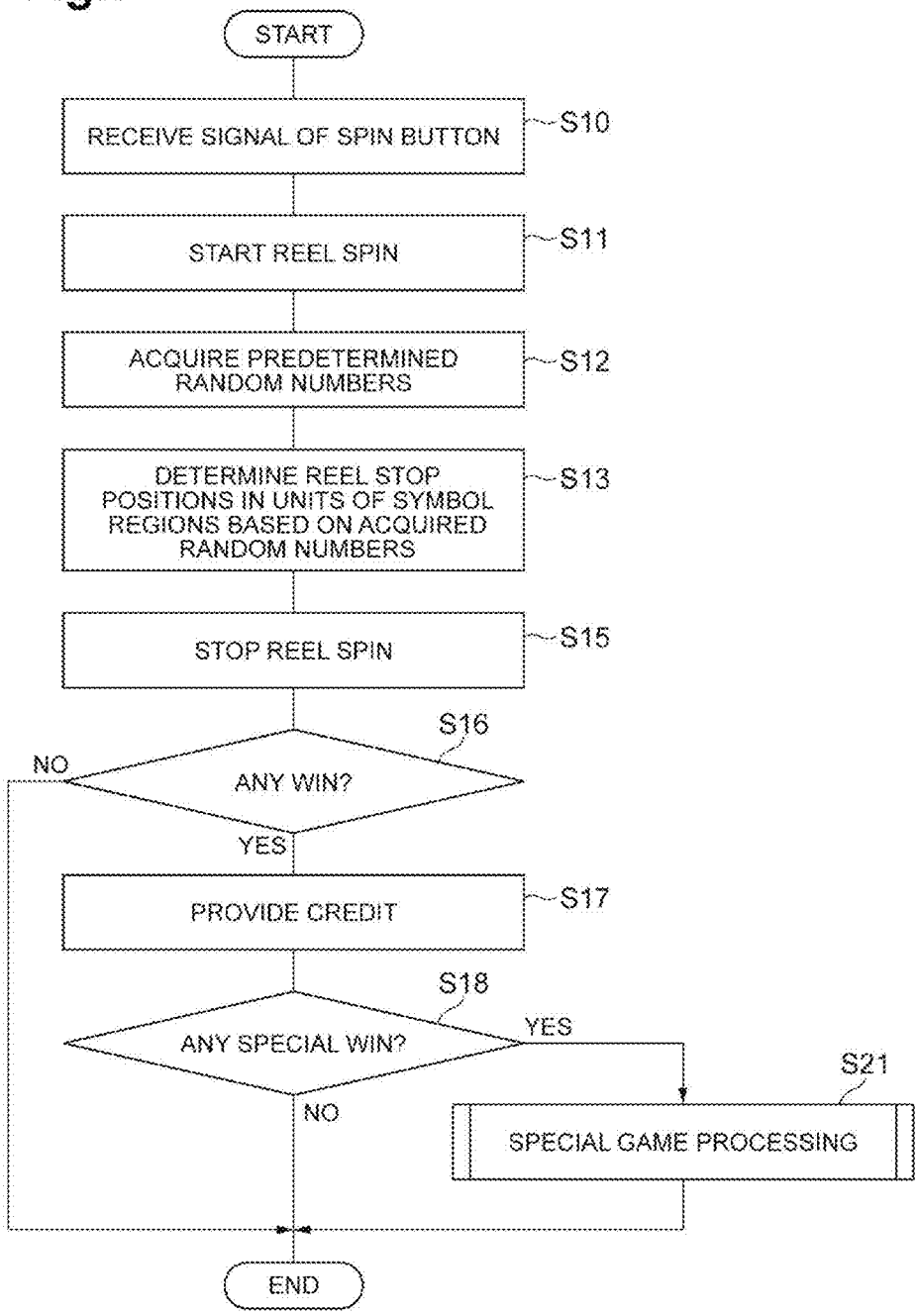
FIG. 7 is an example of the flowchart showing the processing of a normal game according to the first embodiment.
Figure 8:
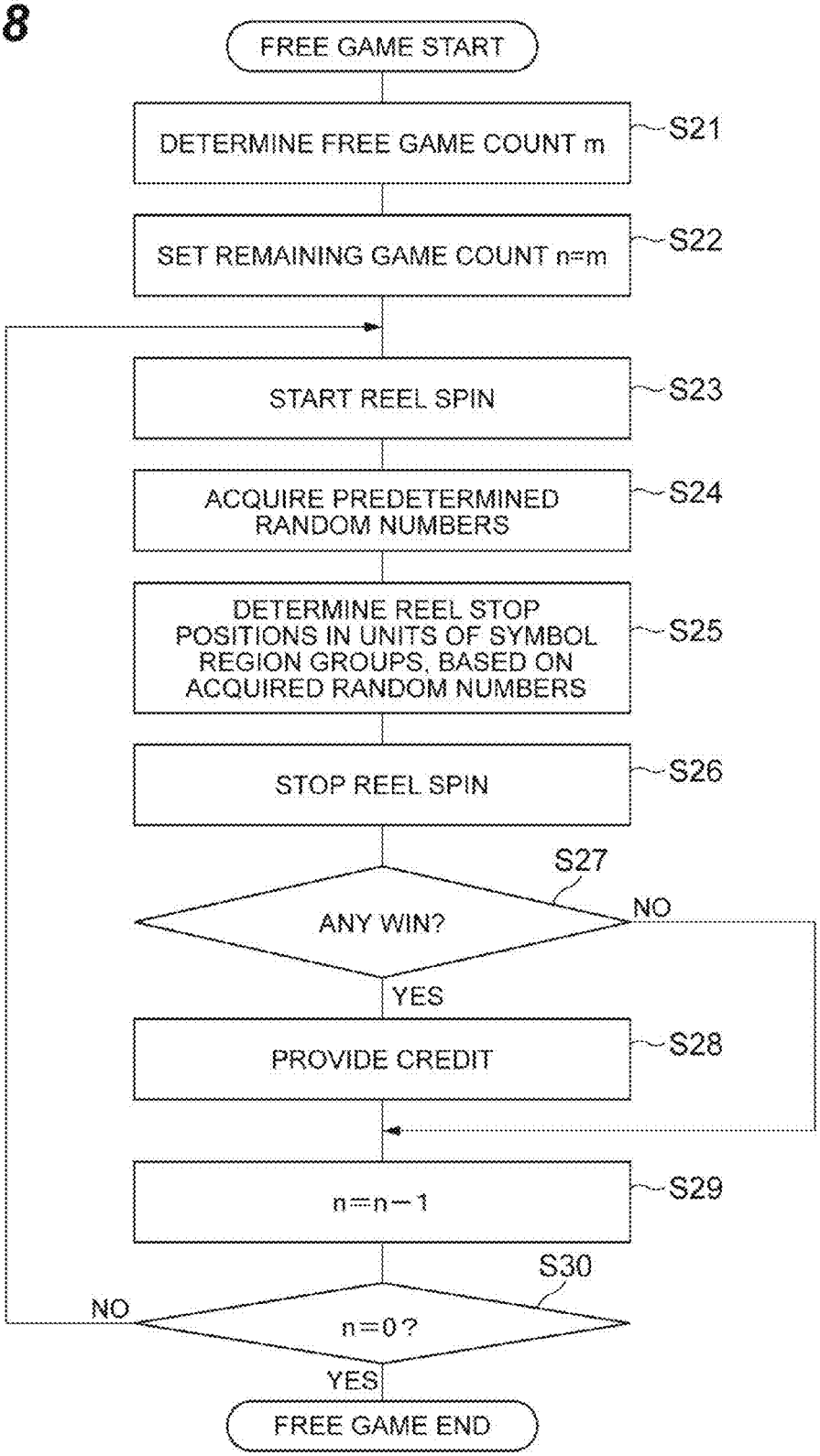
FIG. 8 is an example of the flowchart showing the processing of a special game.

The following is an explanation of operations in the game providing state, as a method for controlling the gaming machine 1, by referring to the flowcharts illustrated in FIG. 7 and FIG. 8.

The gaming machine 1, which has received setting of the number of lines and the number of bets in the input waiting state, and then changed to the game providing state by receiving the operation of the start button, starts a normal game by controlling the upper display device 15 and the lower display device 17 by the controller 20.

The normal game proceeds in accordance with the flowchart of FIG. 7. First, in the processing at S10, the CPU 21 receives a signal of the spin button 7. Determination is repeated if a signal of the spin button 7 is not inputted, and the process proceeds to S11 if a signal of the spin button 7 is inputted. Further, the processing at S10 may proceed to S11 in response to a player's operation of the bet button as described above.

In the processing at S11, the CPU 21 starts displaying spin of the respective reels 2 in the symbol region 51 displayed in the game display 50 on the display unit 18. Subsequently, the process proceeds to S12 and the CPU 21 acquires a predetermined number of random numbers required for providing the game. The random numbers may be internally generated by the CPU 21, or may be acquired by the CPU 21 from a random number generator (not illustrated) that is installed separately in the gaming machine 1, the random numbers may also be acquired from a device, such as a server set up outside the gaming machine 1.

Next, in the processing in S13, the CPU 21 determines a reel stop position in units of symbol regions for each reel 2, based on the random number acquired in S12. In the present embodiment, during a normal game, the reel stop position is determined using the symbol region-unit stop position 2*a* shown in (a) of FIG. 5. For example, the CPU 21 can use one random number for each of the reels 2 to set, as a stop position, the position of the symbol region-unit stop position 2*a* corresponding to the used random number in a predetermined table.

Subsequently, in the processing in S15, the CPU 21 stops the spinning-displayed reel in the symbol display region 51, based on the stop position of each reel determined by the processing in S13. Subsequently, in the processing in S16, the CPU 21 determines whether a symbol combination appearing in the cells 52 in the symbol display region 51 forms a predetermined winning pattern. If a winning pattern is not formed, the operation of a normal game shown in FIG. 7 is terminated. On the other hand, if a winning pattern is formed, the process proceeds to S17. In the processing in S17, the CPU 21 calculates the payment corresponding to the formed winning pattern and gives the player a credit equivalent to the calculated payment. The given credit is accumulated in the gaming machine 1 and can be used to bet on the next and subsequent slot games. When giving a credit is finished, the process proceeds to S18.

In the processing at S18, the CPU 21 determines whether or not the combination of the symbols appearing in the cells 52 of the symbol region 51 forms a predetermined bonus pattern (special win). The predetermined bonus pattern is a condition to apply a bonus game. When no bonus pattern is formed, the operations of the normal game illustrated in FIG. 7 end. In contrast, when any bonus pattern is formed in the processing at S18, a special game is provided in the processing at S21.

FIG. 8 is a flowchart illustrating details of an example of special game processing at S21. In this case, the present embodiment illustrates the case of providing free games to allow the player to play a predetermined number of games equal to normal games without credit consumption as the special games. In the processing, the number m of free games to be provided is determined at S21 first. Here, the number of free games is a set number, with one game being from when a reel spin starts to when it ends and a determination is made as to whether or not any winning pattern is formed (in a case where any winning pattern is formed, further to provision of credit). The CPU 21 may automatically execute a plurality of free games without waiting for a player's input, or may wait for a player's operation after finishing one game and then start the next free game. Further, the number m of free games may be determined in accordance with a combination of the symbols determined to be formed in the cells 52 of the symbol region 51 in the processing at S18. After the determination, the process proceeds to S22 and m is set as the value n of the remaining games of the free games.

The processing in S23 to S28 corresponds to the processing in S11 to S17 in the operation of a normal game shown in FIG. 7. More specifically, display of spinning the reels 2 in the symbol display region 51 is started in S23. A predetermined number of random numbers are acquired in S24. The stop positions of the reels 2 are determined in S25. In the present embodiment, during a free game serving as a special game, the reel stop position is determined using the symbol region group-unit stop position 2*b* shown in (b) of FIG. 5. For example, the CPU 21 can use one random number for each of the reels 2 to set, as a stop position, the position of the symbol region group-unit stop position 2*b* corresponding to the used random number in a predetermined table. Subsequently, in the processing in S26, the reel spin is stopped. In the present embodiment, when the stack symbol 42 stops in the symbol display region 51 during a free game, the entire stack symbol 42 is always displayed and occupies one column (reel) in the symbol display region 51, because in S25 the reel stop position is determined using the symbol region group-unit stop position 2*b* shown in (b) of FIG. 5. Thus, during a free game, wins by the stack symbol 42 increase, and therefore, the win rate, the payout rate, and the degree of variation (volatility) of payments is higher. This configuration provides a free game as a special game that appeals to the player's interest to increase the excitement and gives great satisfaction. That is, a value-added special game can be provided when compared with normal games. During a free game, the entire stack symbol 42 is always displayed, which increases the player's expectations for stack symbols 42 and gives the players great satisfaction.

After the reel spin is stopped in the processing at S26, it is determined whether or not a win is acquired in the processing at S27, a predetermined credit is provided in the processing at S28 if a win is acquired. If it is determined that no win is acquired in the processing at S27, or after credit is provided in the processing at S28, the number n of the remaining games is decremented to n−1 in the processing at S29. Subsequently, whether or not n=0 is determined in the processing at S30, the next and succeeding steps after S32 are repeated if the determination is made that n=0, and the free game providing processing is ended if the determination that n=0 is not made, and the process returns to the flowchart of FIG. 7 to end a series of operations.

As described in details above, according to the present embodiment, in a free game serving as a special game, the reels 2 populated with stack symbols 42 in the symbol region groups 40 are used to determine the reel stop positions in units of symbol region groups 40. Therefore, when the stack symbol 42 stops in the symbol display region 51, the entire stack symbol 42 is always displayed and occupies one column (reel) in the symbol display region 51. This increases wins by the stack symbol 42 and thereby increases the win rate, the payout rate, and/or the degree of variation (volatility) of payment and provides a game that can appeal to the player's interest to increase the excitement and give great satisfaction. In addition, this configuration can increase the player's expectations for the stack symbol 42 and give the player great satisfaction.

According to the present embodiment, the reels 2 populated with the stack symbols 42 in the symbol region groups 40 are used to determine the reel stop positions in units of symbol regions 40*a* in a normal game (first game) and to determine the reel stop positions in units of symbol region groups 40 in a free game serving as a special game (second game). Thus, the first game in which the entire stack symbol is not necessarily displayed and the second game in which the entire stack symbol is always displayed can be used in combination. In the second game in which the entire stack symbol is always displayed, the win rate, the payout rate, and/or the degree of variation (volatility) of payment is higher than that in the first game. This configuration enables provision of games of different natures using the reels having the same layout and appeals to the player's interest to increase the excitement and gives great satisfaction.

As a method other than the method described above for displaying the entire stack symbol, when a stack symbol is partially displayed in the game screen, the reel may be adjusted in position so as to be spun in the direction that allows the entire stack symbol to be displayed. In such a method in which the reel is adjusted in position, however, the progress of the game is halted during position adjustment. Meanwhile, the method in which the gaming machine 1 enables display of the entire stack symbol does not require such position adjustment and enables smooth game progress.

Second Embodiment

The gaming machine 1 according to a second embodiment will now be described.

The configuration and operation of the gaming machine 1 according to the second embodiment is mostly the same as the gaming machine 1 according to the first embodiment, except that the display control of the reels 2 by the CPU 21 is different. In the following description, only the differences from the gaming machine 1 according to the first embodiment will be described, and a description of the same parts will be omitted.

Figure 9:
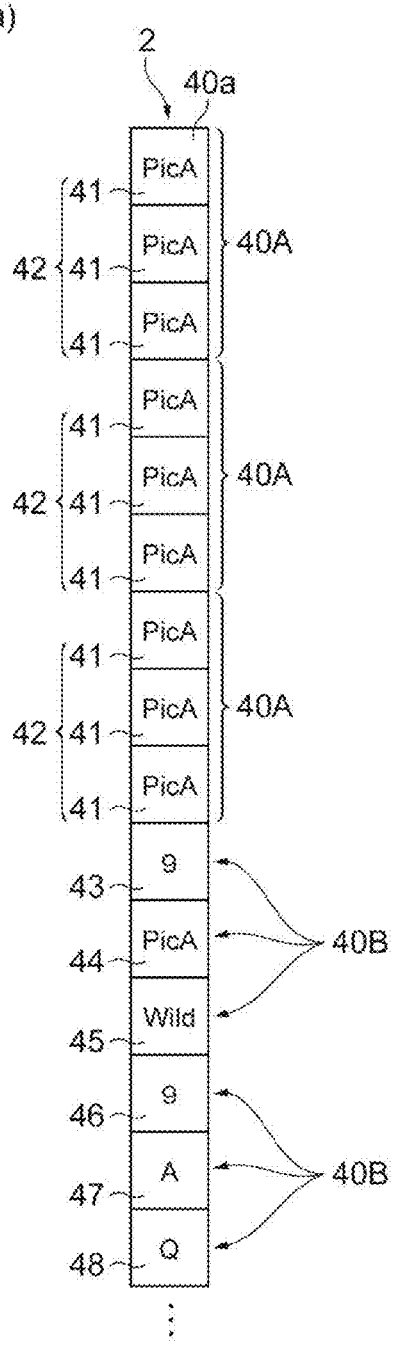
FIG. 9 is a diagram showing (a) an example of a reel and (b) an example of a symbol lot table according to a second embodiment.

In the gaming machine 1 according to the second embodiment, a reel 2A having a symbol arrangement shown in (a) of FIG. 9 is used. The reel 2A includes a plurality of symbol regions 40*a*, each populated with a symbol in the same manner as in the reels 2, and is divided by symbol region groups 40A, 40B, each including three symbol regions 40*a* in a row. The number of the symbol regions 40*a* is designed to be a multiple of three, and each symbol region 40*a* on the reel 2A is included in any one of the symbol region groups 40A, 40B. When the stop positions are determined using the symbol region group-unit stop positions 2*b*, the symbol region groups 40A, 40B serve as units of display of the reel 2, in the same manner as in the symbol region groups 40 of the first embodiment.

The symbol region group 40A is a symbol region group in which a collective drawing of symbols is performed, as will be described later. The symbol regions 40*a* that form a symbol region group 40A are populated with identical symbols 41 (symbol "PicA" in (a) of FIG. 9). The symbols to be arranged are determined by a drawing of lots by the CPU 21. In a drawing of lots, a symbol lot table shown in (b) of FIG. 9 can be used. The symbol lot table shown in (b) of FIG. 9 sets a weight (that is, drawing probability) for each kind of symbols shown in the left column. The weights of the wild symbol ("Wild" in (b) of FIG. 9) and the scatter symbol ("Sc" in (b) of FIG. 9) are 10% and set higher than the weights of other symbols of 8%. The probability that the wild symbol and the scatter symbol are determined to be identical symbols 41 by a drawing of lots is high. Such a table may be included in the program or may be implemented as a data structure different from the program.

A single symbol lot table may be provided or a plurality of symbol lot tables may be provided. When a plurality of symbol lot tables are stored, the symbol lot table to be used in a drawing of lots may be changed according to the game state (for example, between normal games and special games).

In the symbol region group 40A in which a collective drawing of symbols is performed, whichever symbol in the symbol lot table is determined, the stack symbol 42 is constituted with the determined symbol.

The symbol region group 40B is a symbol region group in which an individual drawing of symbols is performed, as will be described later. The symbol to be arranged in each of the symbol regions 40*a* that form a symbol region group 40B is determined by a drawing of lots by the CPU 21. In the drawing of lots, the symbol lot table shown in FIG. 9 may be used.

Figure 10:
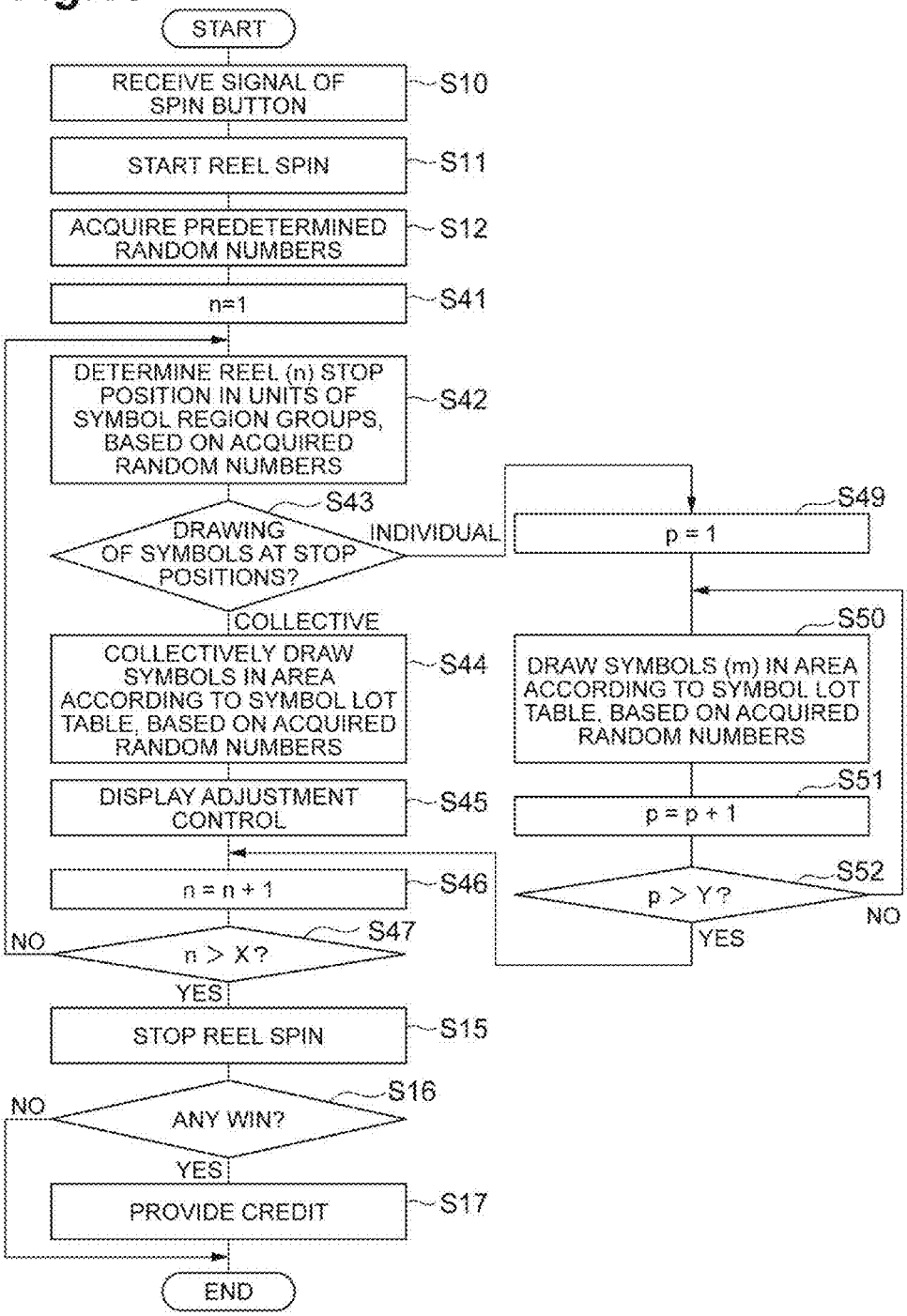
FIG. 10 is an example of the flowchart illustrating the operation of the gaming machine according to the second embodiment.

FIG. 10 is a flowchart showing the operation in the game providing state in the second embodiment. The processing in S10 to S12 in the flowchart in FIG. 10 is similar to the processing in S10 to S12 in the flowchart in FIG. 7 in a normal game in the first embodiment.

Next, in the processing in S41, the CPU 21 sets a parameter n=1 and determines the stop position of the reel (n) that is the n-th reel 2, based on the random number acquired by the CPU 21 in the processing in S42. In the present embodiment, the reel stop position is determined using the symbol region group-unit stop position 2*b* shown in (b) of FIG. 5.

Subsequently, in the processing in S43, it is determined whether the stop position of the reel (n) determined by the CPU 21 is the stop position set in the symbol region group 40A in which a collective drawing of symbols is performed or the stop position set in the symbol region group 40B in which an individual drawing of symbols is performed. If it is determined in the processing in S43 that the stop position is the one set in the symbol region group 40A in which a collective drawing of symbols is performed, the process proceeds to S44.

In the processing in S44, the CPU 21 determines identical symbols 41 to be arranged in the symbol regions 40*a* of the symbol region group 40A, by a collective drawing, in accordance with the symbol lot table shown in (b) of FIG. 9. In the subsequent processing in S45, the CPU 21 performs display adjustment control to arrange the symbols determined in the processing in S44 in all of the three symbol regions 40*a* of the symbol region group 40A. The process thereafter proceeds to S46.

On the other hand, if it is determined in the processing in S43 that the stop position is the one set in the symbol region group 40B in which an individual drawing of symbols is performed, the process proceeds to S49. In the processing in S49, the CPU 21 sets p=1 as initialization processing. After the setting, the process proceeds to S50, and the CPU 21 determines a symbol to be arranged in the p-th symbol region 40*a* of the symbol region group 40B constituted with Y symbol regions 40*a*, by an individual drawing, in accordance with the symbol lot table shown in (b) of FIG. 9 based on a random number. After determining the symbol, the process proceeds to S51, and the CPU 21 increments the parameter to p=p+1. After the setting, the process proceeds to S52, and the CPU 21 determines whether the parameter p>Y is satisfied. If p>Y is not satisfied, the process proceeds to S50. The processing in S50 to S52 is thus repeatedly performed until p>Y is satisfied. In this way, all the symbols for Y symbol regions 40*a* that constitute the symbol region group 40B are determined. If p>Y is satisfied, it means that all the symbols for the symbol regions 40*a* that constitute the symbol region group 40B have been determined. The process then proceeds to S46.

In the processing in S46, the CPU 21 increments the parameter to n=n+1. In the next processing in S47, the CPU 21 determines whether the parameter n>X (X is the number of reels) is satisfied. If n>X is not satisfied, the process proceeds to S42. The processing in S42 to S47 is thus repeatedly performed until n>X is satisfied. All the symbols are thus determined for the symbol region groups 40A, 40B in connection with the stop positions of all of the reels 2. If n>X is satisfied, it means that symbols have been determined for all of the reels 2, and the process then proceeds to S15. The following processing in S15 to S17 is similar to the processing in S15 to S17 in the flowchart in FIG. 7.

Also in the gaming machine of the second embodiment described above, when the CPU 21 determines the symbol region group 40A in which a collective drawing of symbols is performed, as the stop position of the reel 2, the entire stack symbol 42 is displayed in the symbol display region 51.

In addition, in the second embodiment, the kind of the stack symbol 42 to be arranged in the symbol region group 40A is determined by a drawing of lots using the symbol lot table. This configuration provides a varied game progress. In addition, the likelihood of winning a big prize increases depending on the symbol determined by a drawing, which further appeals to the player's interest to increase the excitement and gives great satisfaction.

In the gaming machine 1 of the second embodiment, the identical symbol 41 is determined by a collective drawing by the CPU 21. In this configuration, the determination of the stop position of the reel 2 (the processing in S42 in FIG. 10) and the determination of the kind of the identical symbols 41 (the processing in S44 in FIG. 10) are separately performed by the CPU 21. The game result is thus determined in multiple stages, which also appeals to the player's interest to increase the excitement and gives great satisfaction.

In addition, in the gaming machine 1 of the second embodiment, when the symbol region group 40B determined to be displayed in the symbol display region 51 of the game screen 50 in the lower display device 17 is not populated with identical symbols 41, the CPU 21 determines a symbol to be displayed in the symbol region 40*a* of the symbol region group 40B by an individual drawing. Accordingly, a combination of symbols displayed in the symbol regions 40*a* of the symbol region group 40B is changed with games. A game result varied with games is thus provided, which also appeals to the player's interest more to increase the excitement and gives great satisfaction.

The functions of the controller 20 described above may be implemented not only by a gaming machine but also by execution of the program by various kinds of computers such as personal computers, server computers, smartphones, tablet terminals, and PDAs. Those functions may also be implemented by execution of the program through distributed processing by a system including a gaming machine and a computer connected to communicate with each other or a system including computers connected to communicate with each other.

That is, a program that causes one or more computers to function in the same manner as in the controller 20 described above may be created. The functions implemented by executing such a program are the same as in the controller 20 described above. That is, the functions that appeal to the player's interest to increase the excitement and give great satisfaction are implemented.

In other words, a program can be created to cause one or a plurality of computers to function in the same manner as the controller 20 described above. The function achieved by executing such a program is the same as that of the controller 20 described above, and the like, a function to effectively provide the special event is achieved.

The above program may be recorded and provided in a computer-readable recording medium, such as a random access memory (RAM), a read-only memory (ROM), an erasable programmable read-only memory (EPROM), a flash memory, a hard disk drive, a solid state drive, a floppy (registered trademark) disk, a flash drive, a compact disk, and a digital video disk.

Figure 11:
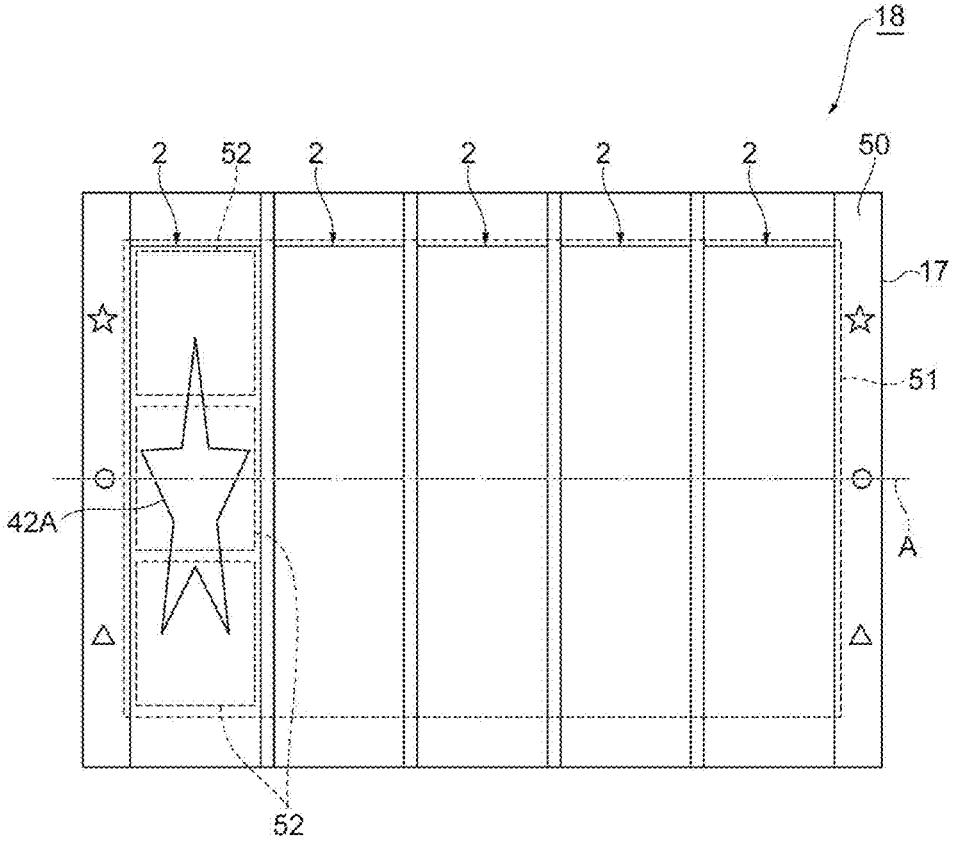
FIG. 11 is a diagram showing a stack symbol in a different manner.

For example, a stack symbol may not be constituted with identical symbols but may be constituted with correlated symbols. Examples of the correlated symbols include a large picture pattern 42A extending across a plurality of cells 52 as shown in FIG. 11, that is, symbols that constitute a single picture pattern in the stack symbol as a whole. In the case of such a stack symbol 42A, a picture pattern larger than the size of the symbol region 40*a* or the cell 52 can be displayed.

The number of symbols that constitute a stack symbol is not limited to three but may be increased or decreased as appropriate. For example, the number of symbols that constitute a stack symbol may be changed according to the number of cells extending in the vertical direction of the game screen, such that all the cells aligned in the vertical direction of the game screen are occupied by a stack symbol.

Figure 12:
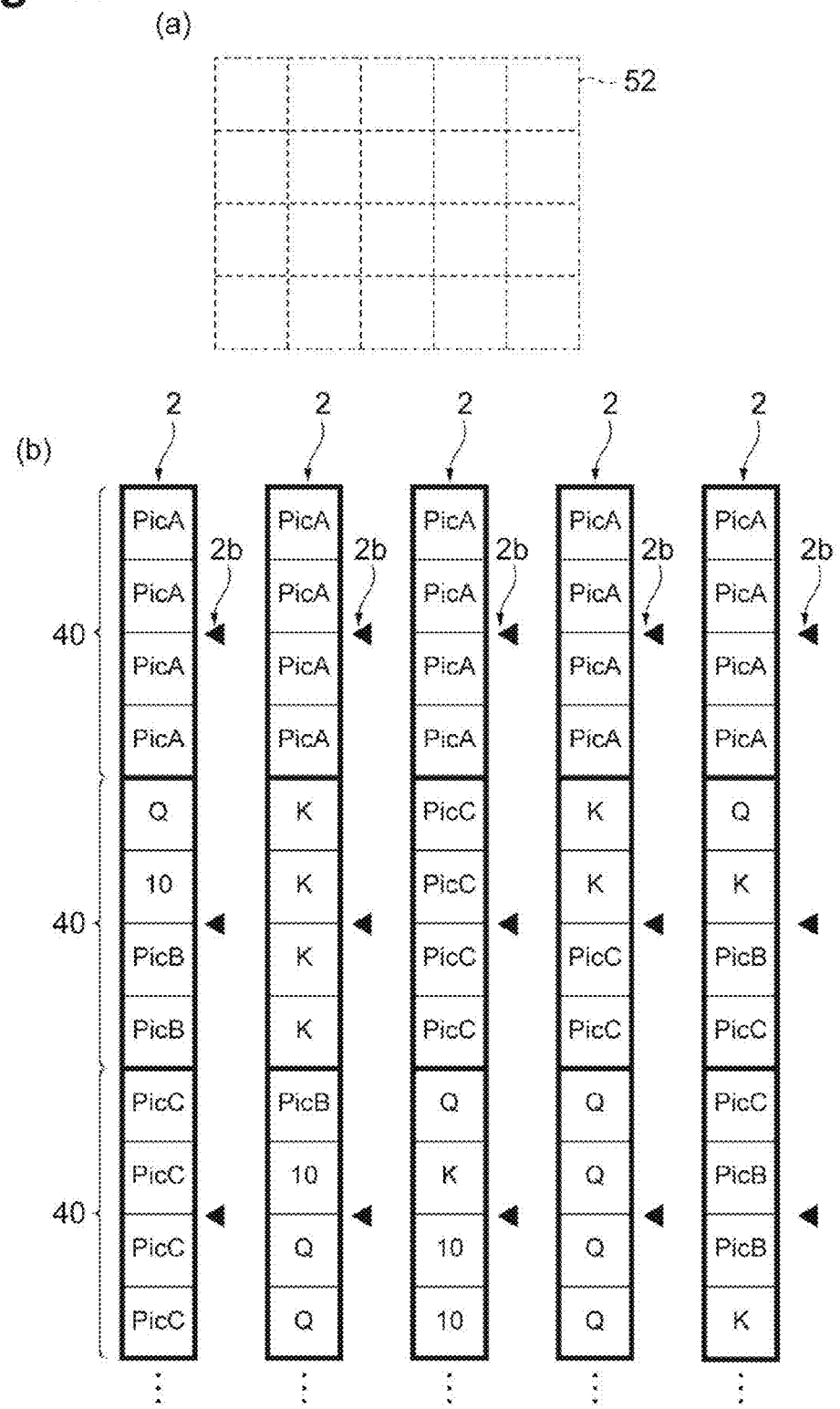
FIG. 12 is a diagram showing (a) a symbol display region and (b) a reel configuration in a manner different from the first embodiment and the second embodiment.
Figure 13:
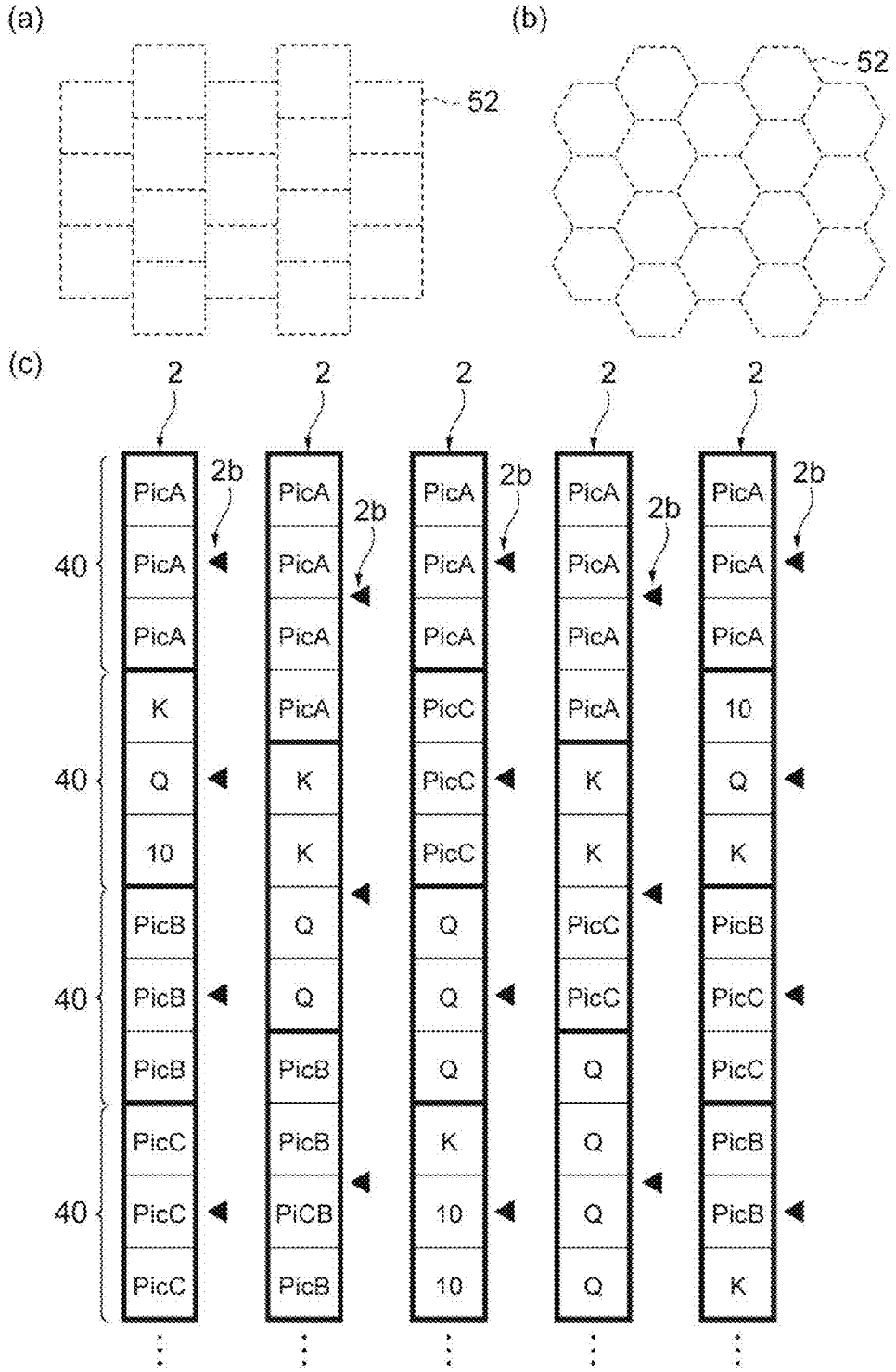
FIG. 13 is a diagram showing (a) and (b) symbol display regions, and (c) a reel configuration in a manner different from the first embodiment and the second embodiment.

For example, when the symbol display region 51 is constituted with five columns and four rows as shown in (a) of FIG. 12, the symbol region group 40 may be divided by four symbol regions 40*a* as shown in (b) of FIG. 12, and the stop position of the reel 2 may be controlled in units of symbol region groups 40. By arranging a stack symbol in the symbol region group 40 in such a configuration, the entire stack symbol is always displayed when the stack symbol stops in the symbol display region 51, in the same manner as in the foregoing embodiments. When the symbol display region 51 is constituted with three rows, four rows, three rows, four rows, and three rows as shown in (a) and (b) of FIG. 13, symbol region groups are divided by the number of symbol regions that are displayed in the symbol display region 51 for the reel, as shown in (c) of FIG. 13, and a corresponding stack symbol is arranged, whereby the same effects can be achieved.

Figure 14:
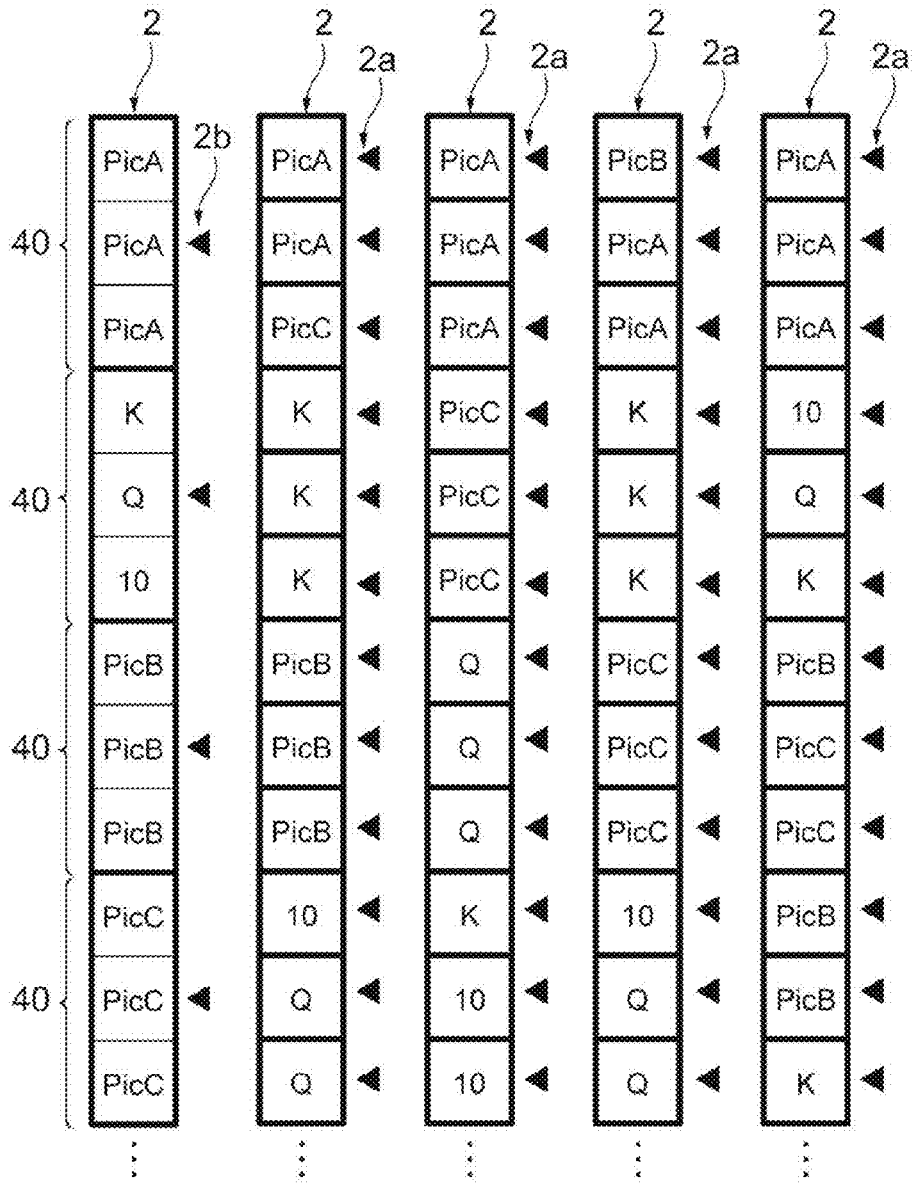
FIG. 14 is a diagram showing a reel configuration in a manner different from the first embodiment and the second embodiment.
Figure 15:
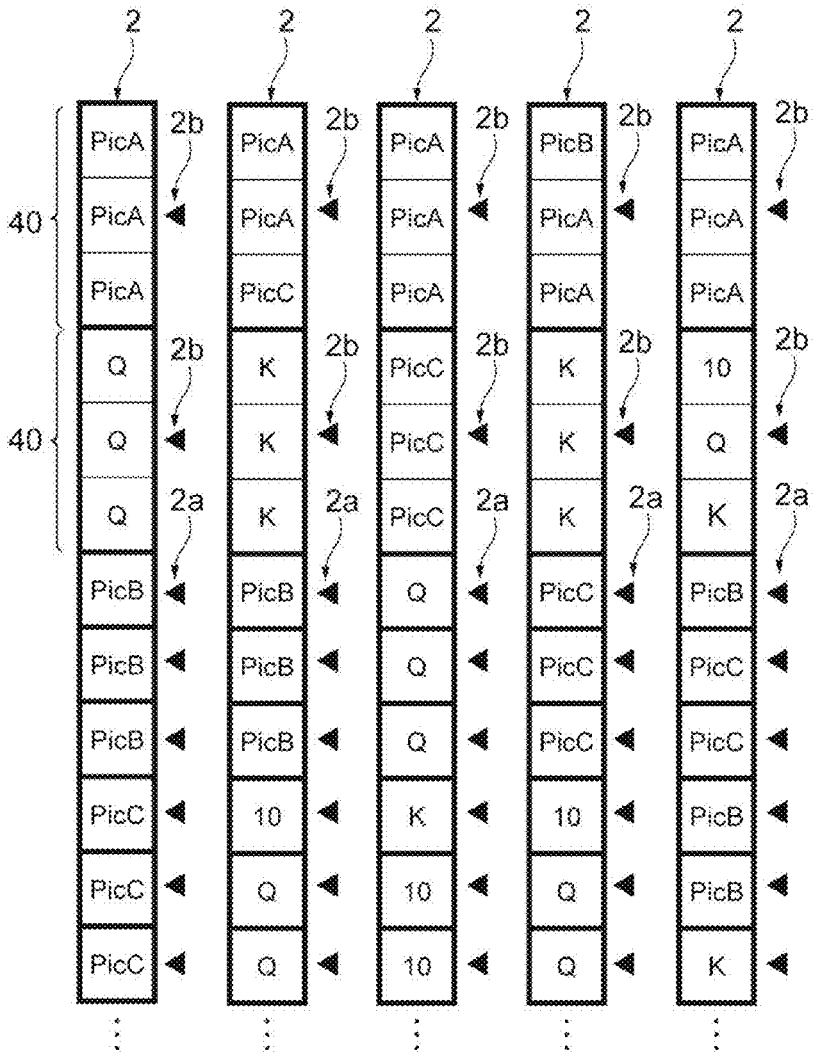
FIG. 15 is a diagram showing a reel configuration in a manner different from the first embodiment and the second embodiment.

Alternatively, as shown in FIG. 14, the stop position may be determined by the symbol region group-unit stop position 2*b* only in some of the reels 2 (in FIG. 14, the first reel on the left end), whereas the stop position may be determined by the symbol region-unit stop position 2*a* in the other reels 2. Alternatively, as shown in FIG. 15, the symbol region-unit stop position 2*a* and the symbol region group-unit stop position 2*b* may be used in combination in one of the reels 2. That is, one reel 2 may have both of a part in which the stop position is determined in units of symbol region groups 40 using the symbol region group-unit stop position 2*b*, and a part in which the stop position is determined in units of symbol regions 40*a* using the symbol region-unit stop position 2*a*.

In the first embodiment, a special game is provided that determines the stop position in units of symbol region groups 40 when a predetermined condition is satisfied in a normal game that determines the stop position in units of symbol regions 40*a*. However, the stop position may be determined in units of symbol region groups 40 in a normal game. The determination of the stop position in units of symbol region groups 40 may be provided as a special event adopted in a normal game. Alternatively, the stop position may be determined in units of symbol region groups 40 when an additional credit is bet.

For example, in a manner in which the stop control is performed in units of symbol region groups in a special game such as a free game, a stack symbol may not be used in a normal game but a stack symbol may be used only in a special game. Alternatively, a stack symbol may be used in a limited extent in a normal game, whereas the use of stack symbols may be extended in a special game. Examples of the extended use of stack symbols in a special game include increasing the symbols in a row included in a stack symbol, increasing the number of stack symbols, setting the symbols included in a stack symbol as a large-amount dividend symbols only in a special game, and setting a stack symbol as a special symbol such as a wild or multiplier only in a special game. Such manners and configurations enable representation with even greater diversity throughout the game and provide the player with greater satisfaction.

Alternatively, the number of symbol regions per the reel 2 displayed in the symbol display region 51 of the display unit 18 may be changed according to a predetermined condition, and the number of the symbol regions 40*a* that form the symbol region group 40 included in the reel 2 may be changed. For example, the number of the symbol regions 40*a* displayed may be changed from three to four, and in this case, the number of the symbol regions 40*a* that form the symbol region group 40 included in the reel 2 may be changed from three to four likewise. By doing so, one column (reel) in the symbol display region 51 can be occupied by the symbol region group 40 as a whole, in the same manner as before the number of the symbol regions 40*a* is changed. Such a configuration can be applied both when the number of the symbol regions 40*a* is increased and when it is decreased. Such a configuration can be provided by modifying the virtual reel strip that forms the reel 2 when the number of the symbol regions 40*a* displayed is changed, or can be provided by switching between virtual reel strips. The number of the symbol regions 40*a* displayed may be changed in some of the reels 2 or in all of the reels 2.

REFERENCE SIGNS LIST

1 . . . gaming machine, 2, 2 . . . A reel, 17 . . . lower display device, 21 . . . CPU, 22 . . . memory, 40, 40A, 40B . . . symbol region group, 40*a* . . . symbol region, 41, 43 to 48 . . . symbol, 42, 42A stack symbol.

The invention claimed is:

1. A gaming machine comprising:

a display device configured to display a symbol display region including a plurality of reels, the symbol display region including a plurality of cells arranged in a matrix including a plurality of rows and a plurality of columns, each reel being associated with a column; and a controller connected to the display device to control display of the display device, wherein the controller includes a processor programmed to:

generate each reel of the plurality of reels having a plurality of symbol regions populated with symbols and a plurality of unit stop positions;

generate at least one reel having a plurality of symbol region groups, each symbol region group including a number of consecutive symbol regions and an associated group-unit stop position of a plurality of group-unit stop positions of the at least one reel, the at least one reel including a total number of symbol regions equal to a multiple of the number of consecutive symbol regions in each symbol region group, and a number of group-unit stop positions that is less than the total number of symbol regions; and determine a stop position of each of the plurality of reels and spin and stop each of the plurality of reels displayed on the display device based on each determined stop position, wherein the determination of the stop position of the at least one reel is based on a selection of an associated group-unit stop position of the plurality of group-unit stop positions.

2. The gaming machine according to claim 1, wherein the symbol region group is populated with identical or correlated symbols in the symbol regions that form the symbol region group.

3. The gaming machine according to claim 2, wherein the identical symbols are determined by a drawing of lots by the controller.

4. The gaming machine according to claim 2, wherein the correlated symbols constitute a single picture pattern as a whole.

5. The gaming machine according to claim 2, wherein, for the symbol region group that is neither populated with the identical nor correlated symbols, the controller determines symbols to be displayed in the symbol regions of the symbol region group by an individual drawing of lots.

6. The gaming machine according to claim 1, wherein the controller performs a winning determination by a combination of symbols displayed on the display device.

7. The gaming machine according to claim 1, wherein the number of consecutive symbol regions that form the symbol region group is equal to a number of cells displayed by the display device in a column associated with the at least one reel.

8. The gaming machine according to claim 1, wherein the controller changes the number of cells per column displayed by the display device, according to a predetermined condition, and changes the number of consecutive symbol regions that form the symbol region group included in the at least one reel.

9. The gaming machine according to claim 1, wherein each symbol region group includes three consecutive symbol regions.

10. The gaming machine according to claim 1, wherein each consecutive symbol region of a corresponding symbol region group associated with a corresponding determined stop position is displayed in each cell of a corresponding column with the at least one reel in a stopped position.

11. The gaming machine according to claim 1, wherein the at least one reel includes a plurality of individual symbol regions and a plurality of symbol region-unit stop positions, each symbol region-unit stop position associated with a corresponding individual symbol region.

12. A gaming machine comprising:

a display device configured to display a symbol display region including a plurality of reels, and a controller connected to the display device to control display of the display device, wherein the controller is programmed to:

generate each reel of the plurality of reels having a plurality of symbol regions populated with symbols and a plurality of unit stop positions;

provide a first game including generating each reel including a unit stop position associated with each symbol region; and provide a second game including generating at least one reel having a plurality of symbol region groups, each symbol region group including a number of consecutive symbol regions and an associated group-unit stop position of a plurality of group-unit stop positions of the at least one reel, the at least one reel including a total number of symbol regions equal to a multiple of the number of consecutive symbol regions in each symbol region group, and a number of group-unit stop positions that is less than the total number of symbol regions; and the controller determining a stop position of each of the plurality of reels and spin and stop each of the plurality of reels displayed on the display device based on each determined stop position, wherein determining the stop position of the at least one reel is based on a selection of an associated group-unit stop position of the plurality of group-unit stop positions.

13. The gaming machine according to claim 12, wherein the controller provides the second game when a predetermined condition is satisfied in the first game.

14. A gaming method that provides a game using a display device and a controller, the display device being configured to display a symbol display region including a plurality of reels, the controller being connected to the display device to control display of the display device, the method comprising the controller performing the steps of:

generating each reel of the plurality of reels having a plurality of symbol regions populated with symbols and a plurality of unit stop positions;

generating at least one reel having a plurality of symbol region groups, each symbol region group including a number of consecutive symbol regions and an associated group-unit stop position of a plurality of group-unit stop positions of the at least one reel, the at least one reel including a total number of symbol regions equal to a multiple of the number of consecutive symbol regions in each symbol region group, and a number of group-unit stop positions that is less than the total number of symbol regions; and determining a stop position of each of the plurality of reels and spin and stop each of the plurality of reels displayed on the display device based on each determined stop position, wherein determining the stop position of the at least one reel is based on a selection of an associated group-unit stop position of the plurality of group-unit stop positions.

15. A non-transitory computer-readable recording medium storing a program for causing one or more computers to implement a function of providing a game using a display device and a controller, the display device being configured to display a symbol display region including a plurality of reels, the controller being connected to the display device to control display of the display device, the program causing the one or more computers to function as a controller that:

generates each reel of the plurality of reels having a plurality of symbol regions populated with symbols and a plurality of unit stop positions;

generates at least one reel having a plurality of symbol region groups, each symbol region group including a number of consecutive symbol regions and an associated group-unit stop position of a plurality of group-unit stop positions of the at least one reel, the at least one reel including a total number of symbol regions equal to a multiple of the number of consecutive symbol regions in each symbol region group, and a number of group-unit stop positions that is less than the total number of symbol regions; and determines a stop position of each of the plurality of reels and spin and stop each of the plurality of reels displayed on the display device based on each determined stop position, wherein the determination of the stop position of the at least one reel is based on a selection of an associated group-unit stop position of the plurality of group-unit stop positions.

* * * * *